US008793847B2

(12) United States Patent
Chung

(10) Patent No.: US 8,793,847 B2
(45) Date of Patent: Aug. 5, 2014

(54) DOUBLE-LAYER NYLON ZIPPER

(76) Inventor: Roger C. Y. Chung, New Taipei (TW)

( * ) Notice: Subject to any disclaimer, the term of this patent is extended or adjusted under 35 U.S.C. 154(b) by 176 days.

(21) Appl. No.: 13/557,171

(22) Filed: Jul. 24, 2012

(65) Prior Publication Data

US 2013/0340213 A1 Dec. 26, 2013

Related U.S. Application Data

(63) Continuation-in-part of application No. 13/527,597, filed on Jun. 20, 2012, now abandoned.

(51) Int. Cl.
*A44B 19/34* (2006.01)

(52) U.S. Cl.
USPC ..... 24/382; 24/415; 24/427; 24/383

(58) Field of Classification Search
CPC ..... A44B 19/00; A44B 19/32; A44B 19/26; A44B 19/12; A45C 13/103
USPC ..... 24/382, 383, 415, 426, 427, 428
See application file for complete search history.

(56) References Cited

U.S. PATENT DOCUMENTS

| | | | | |
|---|---|---|---|---|
| 4,601,085 | A * | 7/1986 | Yoshida et al. | 24/384 |
| 7,891,061 | B2 | 2/2011 | Lin | |
| 8,132,303 | B2 | 3/2012 | Lin | |
| 2013/0104348 | A1 * | 5/2013 | Wang | 24/392 |

* cited by examiner

*Primary Examiner* — Robert J Sandy
*Assistant Examiner* — Michael Lee
(74) *Attorney, Agent, or Firm* — Pai Patent & Trademark Law Firm; Chao-Chang David Pai

(57) ABSTRACT

A double-layer nylon zipper includes two zipper tapes each having two series of teeth respectively disposed at opposing top and bottom sides of the fabric strip thereof, and a zipper slider coupled between the interlocking series of teeth of the two zipper tapes and having opposing top guard frame wall and bottom guard frame wall, a division wall between the top and bottom guard frame walls, a nose located on the top guard frame wall and a pull tap coupled to the nose. The top guard frame wall and bottom guard frame wall have respective first ends kept in flush and respective second ends in different lengths so that an accommodation space is defined right below the second end of the top guard frame wall outside the second end of the bottom guard frame wall to facilitate smooth interlocking of the interlocking series of teeth.

8 Claims, 7 Drawing Sheets

DOUBLE-LAYER NYLON ZIPPER

CROSS REFERENCE TO RELATED APPLICATIONS

This application is a Continuation-in-part of pending U.S. patent application Ser. No. 13/527,597, filed Jun. 20, 2012 and entitled "DOUBLE-LAYER NYLON ZIPPER".

BACKGROUND OF THE INVENTION (a) Field of the Invention

The present invention relates to zip fasteners and more particularly to a double-layer nylon zipper, which is practical for use in a travel bag, backpack or tent.

(b) Description of the Prior Art

Most conventional nylon zippers are of a single layer design. A single-layer nylon zipper is not strong enough. Simply inserting the tip of a ball pen or a sharp end of a rod into a gap between the two interlocked series of teeth of a single-layer nylon zipper can open the zipper easily. Thus, using a single-layer nylon zipper in a travel bag or the like cannot effectively protect stored items against loss or theft. To solve this problem, double-layer nylon zippers are developed. For example, Taiwan Patent Publication Number 441257 discloses a double-layer nylon zipper, which has an interlocking series of teeth arranged at each of the opposing top and bottom sides of each zipper tape to provide an anti-piercing function.

However, in conventional double-layer zipper designs (such as U.S. Pat. No. 8,132,303, U.S. Pat. No. 7,891,061), the opposing top and bottom walls of the zipper slide have the same length. When a double-layer zipper is used in a corner of a travel bag or backpack, the difference in close angle between the two layers of interlocking teeth causes the double-layer zipper unable to overcome the strong tension during closing of the two layers of interlocking teeth in the corner area, leading to one layer of the interlocking teeth closed and the other layer of interlocking teeth burst open.

Further, the interlocking series of teeth of each zipper tape of a double-layer nylon zipper is formed of a left-handed or right-handed series of coil elements of a plastic wire material and fastened to the narrow elongated fabric strip of the respective zipper tape with a respective stitching line. When moving the zipper slider relative to the zipper tapes, the stitching lines of the zipper tapes are kept in direct contact with the zipper slider. Friction between the top and bottom stitching lines of the zipper tapes and the zipper slider can damage the stitching lines, shortening the lifetime of the zipper. Therefore, conventional zippers have numerous drawbacks.

SUMMARY OF THE INVENTION

The present invention has been accomplished under the circumstances in view. A main object of the present invention to provide a double-layer nylon zipper, which enhances positive coupling between the interlocking series of teeth and the zipper slider, facilitates smooth operation of the zipper slider over a curved corner area, and avoids the problem of stuck zipper or zipper teeth damage as commonly seen in the prior art design. Thus, the double-layer nylon zipper is practical for use in a travel bag, backpack, or the like.

A another object of the present invention is to provide a double-layer nylon zipper, which avoids direct contact between the stitching lines and the zipper slider, eliminating stitching line wearing problem seen in the prior art design and preventing stitching line damage.

To achieve these and other objects of the present invention, a double-layer nylon zipper comprises two zipper tapes, and a zipper slider. Each zipper tape comprises a narrow elongated fabric strip, two series of teeth respectively located on opposing top and bottom sides of the narrow elongated fabric strip, each series of teeth being formed of a series of coil elements made of a plastic wire material, each coil element comprising a coil head and a coil body, wherein the coil head has a width greater than the diameter of the coil elements, a coil body connected to the coil head and a wire groove located on the coil body, a cloth strip covered over the coil body of each element of the series of teeth at the bottom side of the narrow elongated fabric strip, and a stitching line stitched to the narrow elongated fabric strip and the cloth strip and extended over a part of the cloth strip corresponding to the wire groove on the coil body of each coil element of the series of teeth at the bottom side of the narrow elongated fabric strip to secure the two series of teeth and the cloth strip to the narrow elongated fabric strip. The zipper slider is coupled between the interlocking series of teeth of the two zipper tapes, comprising a opposing top guard frame wall and bottom guard frame wall, a division wall vertically connected between the top guard frame wall and the bottom guard frame wall, a nose located on the top side of the top guard frame wall, and a pull tap coupled to the nose. The top guard frame wall and the bottom guard frame wall each comprise opposing first end and second end. The first end of the top guard frame wall and the first end of the bottom guard frame wall are kept in a flush manner. The top guard frame wall is relatively longer than the bottom guard frame wall so that the second end of the top guard frame wall protrudes over the second end of the bottom guard frame wall, defining an accommodation space right below the second end of the top guard frame wall outside the second end of the bottom guard frame wall to facilitate smooth interlocking of the interlocking series of teeth and to prevent the zipper teeth from getting stuck or damaged.

Further, the top guard frame wall comprises two downward guard flanges respectively downwardly extending from two opposing lateral sides thereof toward the bottom guard frame wall. Further, each downward guard flange comprises a chamfered edge terminating in the second end of the top guard frame wall. The bottom guard frame wall comprises two upward guard flanges respectively upwardly extending from two opposing lateral sides thereof toward the top guard frame wall. Further, each upward guard flange comprises a chamfered edge terminating in the second end of the bottom guard frame wall. When pulling the zipper slider over an angle corner of a travel bag, for example, the design of the accommodation space and the chamfered edge of each upward guard flange of the bottom guard frame wall effectively prevent interference between the zipper slider and the interlocking series of teeth, thus facilitating smooth interlocking of the interlocking series of teeth and preventing the zipper teeth from getting stuck or damaged.

Further, each coil element of the interlocking series of teeth of each zipper tape comprises a wire groove located on the coil body for receiving the stitching line that fastens the respective interlocking series of teeth to the respective narrow elongated fabric strip. The design of the wire groove avoids direct contact between the stitching lines and the zipper slider and further stitching line damage. Further, the stitching line at each zipper tape sinks in the respective cloth strip corresponding to the wire groove on the coil body of each coil element of the series of teeth at the bottom side of the associating narrow elongated fabric strip, avoiding direct contact with the zipper slider. Further, the position of the cloth strip helps quick recognition of the front and back sides of the double-layer nylon zipper during stitching of the bag.

DETAILED DESCRIPTION OF THE PREFERRED EMBODIMENTS

Figure 1:
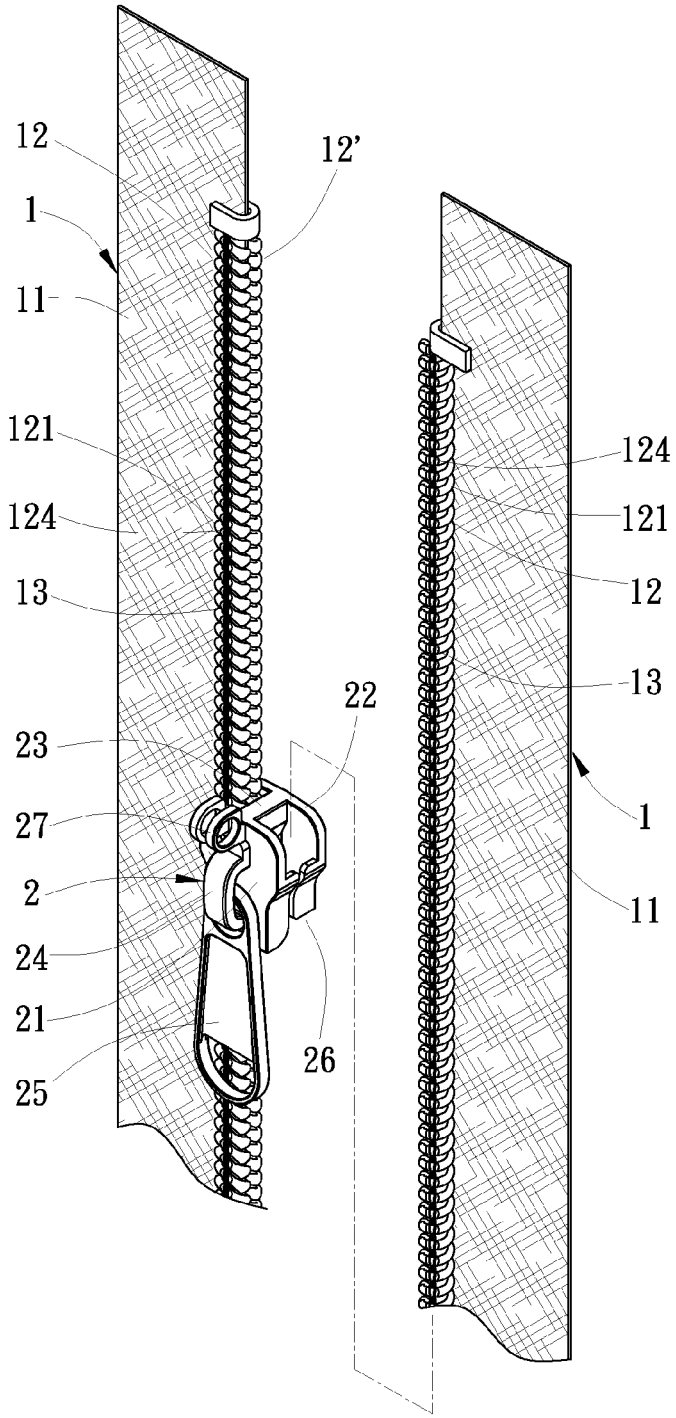
FIG. 1 is an exploded view of a double-layer nylon zipper in accordance with the present invention.
Figure 2:
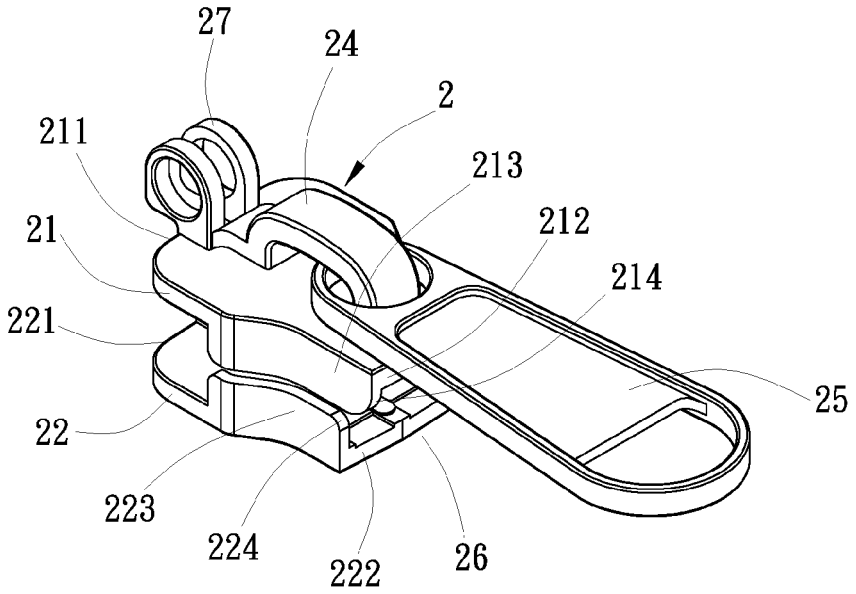
FIG. 2 is an elevational view of a zipper slider for double-layer nylon zipper in accordance with the present invention.
Figure 3:
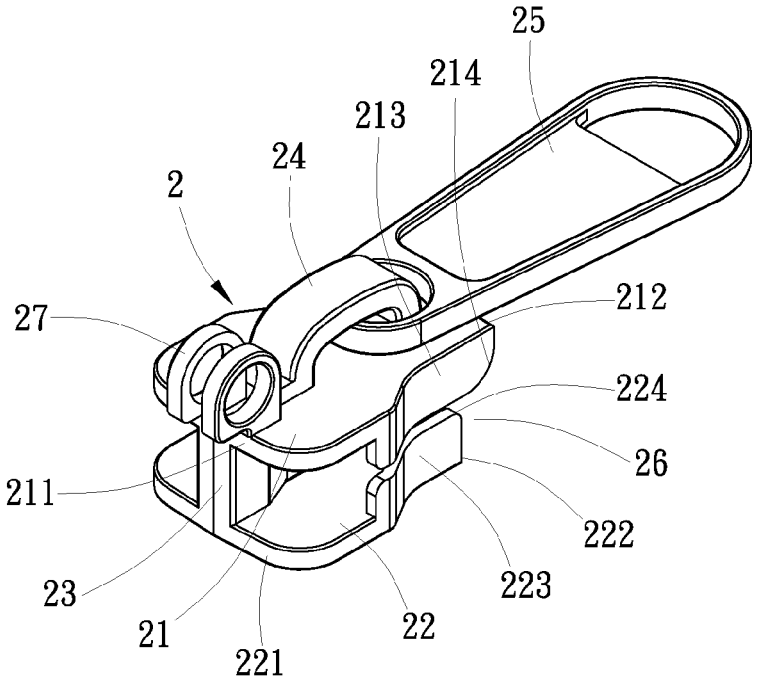
FIG. 3 corresponds to FIG. 2 when viewed from another angle.

As shown in FIG. 1, a double-layer nylon zipper in accordance with the present invention comprises two zipper tapes 1, and a zipper slider 2.

Figure 6:
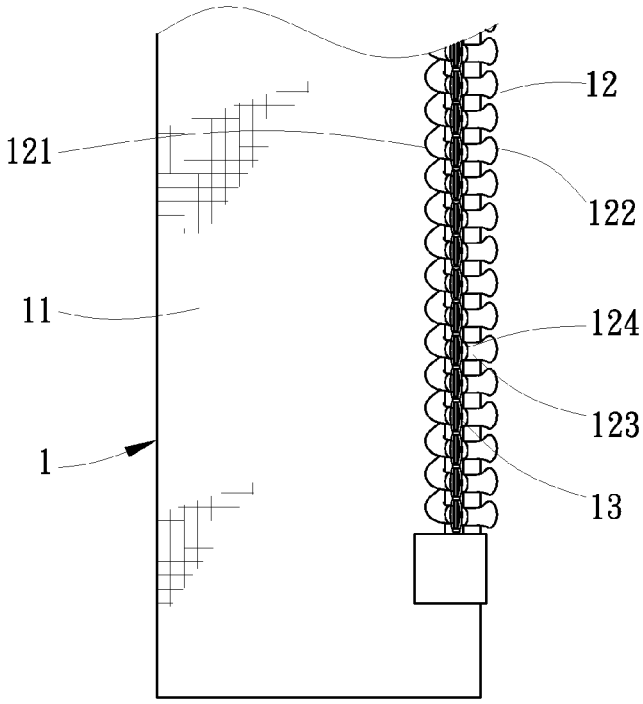
FIG. 6 is a front view of a part of the double-layer nylon zipper in accordance with the present invention.
Figure 7:
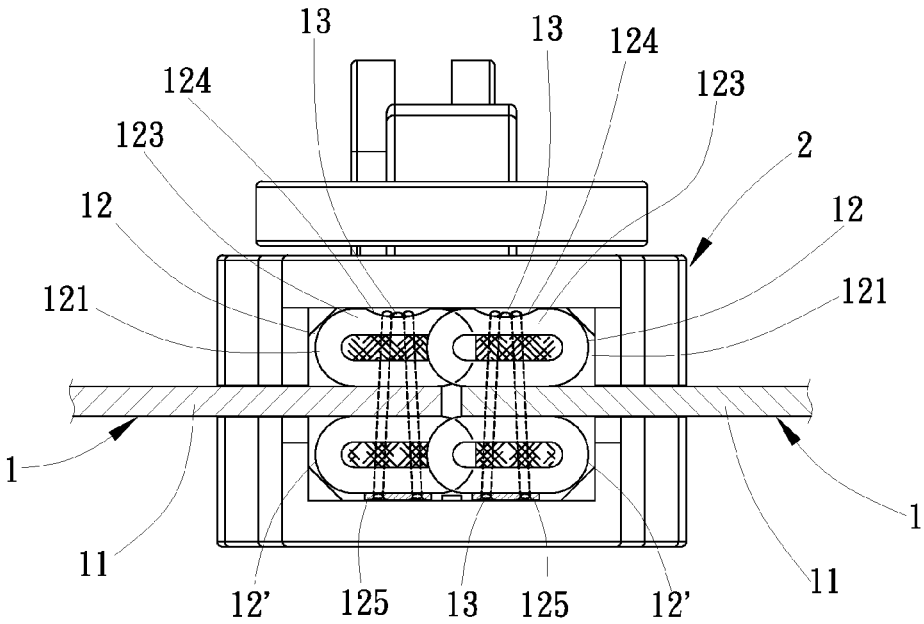
FIG. 7 is a schematic sectional view of the double-layer nylon zipper in accordance with the present invention.

Referring to FIGS. 6 and 7 and FIG. 1 again, each zipper tape 1 comprises a narrow elongated fabric strip 11, two interlocking series of teeth 12,12' respectively located on opposing top and bottom sides of the narrow elongated fabric strip 11, and a stitching line 13, which secures the interlocking series of teeth 12,12' to the narrow elongated fabric strip 11. Further, the narrow elongated fabric strip 11 is a nylon fabric strip.

Figure 8:
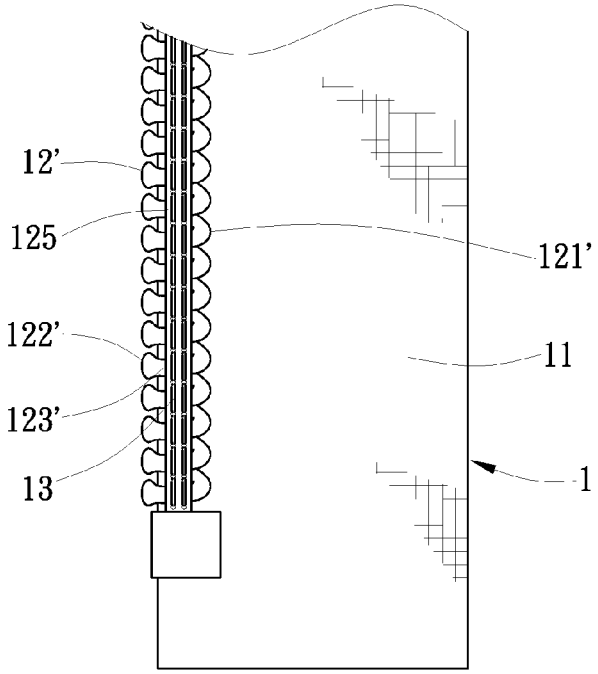
FIG. 8 is a back side view of a part of the double-layer nylon zipper in accordance with the present invention.
Figure 9:
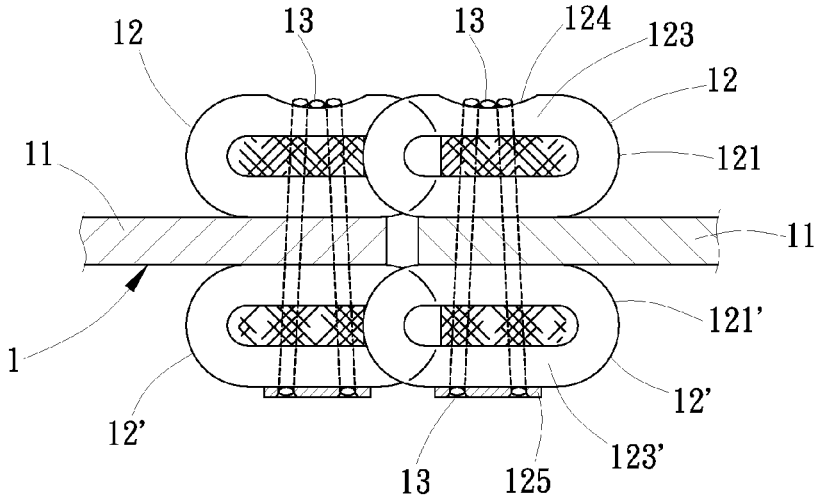
FIG. 9 is a schematic sectional view of the zipper tapes of the double-layer nylon zipper in accordance with the present invention.

Referring to FIGS. 6-9, the interlocking series of teeth 12,12' are respectively formed of a left-handed or right-handed series of coil elements 121,121' of a plastic wire material. Each coil element 121,121' of the interlocking series of teeth 12,12' comprises a coil head 122,122', and a coil body 123,123' stitched to the narrow elongated fabric strip 11. As shown in FIG. 6 and FIG. 7, the coil body 123,123' defines a wire groove 124 for receiving the respective stitching line 13. As shown in FIG. 8 and FIG. 9, a cloth strip 125 is covered over the coil body 123' of each coil element 121' of the interlocking series of teeth 12' at the bottom side of the narrow elongated fabric strip 11. The stitching line 13 extends over the wire groove 124 of the coil body 123 of each coil element 121 at the top side of the narrow elongated fabric strip 11 and each coil element 121' and the cloth strip 125 at the bottom side of the narrow elongated fabric strip 11, firmly securing the respective series of teeth 12,12' to the top and bottom sides of the narrow elongated fabric strip 11.

Figure 4:
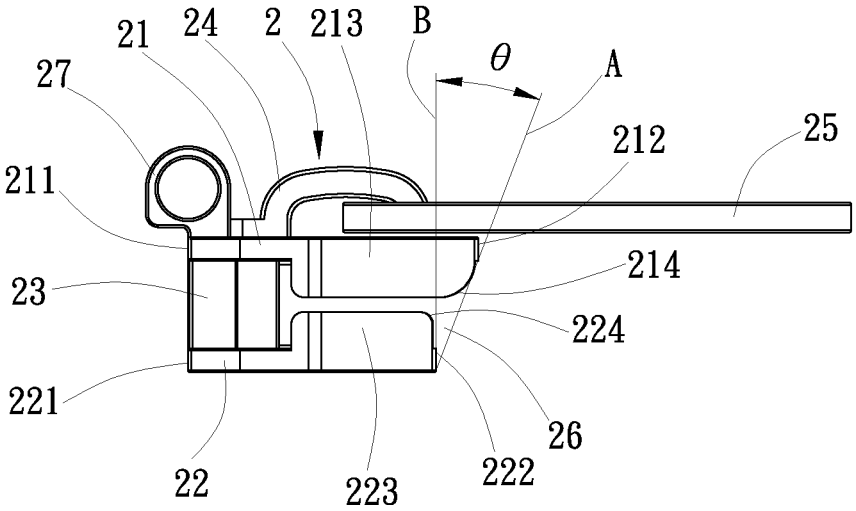
FIG. 4 is a side view of the zipper slider for double-layer nylon zipper in accordance with the present invention.
Figure 5:
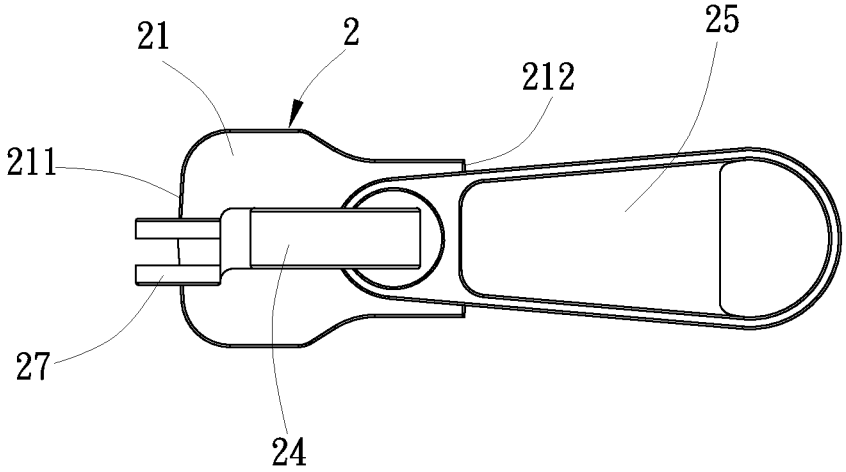
FIG. 5 is a top view of the zipper slider for double-layer nylon zipper in accordance with the present invention.

Referring to FIGS. 2-5, the zipper slider 2 is coupled between the two zipper tapes 1, comprising a top guard frame wall 21 and an opposing bottom guard frame wall 22, a division wall 23 vertically connected between the top guard frame wall 21 and the bottom guard frame wall 22, a nose 24 disposed on the top side of the top guard frame wall 21, and a pull tap 25 coupled to the nose 24. The top guard frame wall 21 and the bottom guard frame wall 22 each comprise a first end 211,221 and an opposing second end 212,222. The first end 211 of the top guard frame wall 21 and the first end 221 of the bottom guard frame wall 22 are disposed in a flush manner. The division wall 23 is vertically connected between the first end 211 of the top guard frame wall 21 and the first end 221 of the bottom guard frame wall 22 on the middle. The top guard frame wall 21 is relatively longer than the bottom guard frame wall 22 so that the second end 212 of the top guard frame wall 21 protrudes over the second end 222 of the bottom guard frame wall 22, defining an accommodation space 26 right below the second end 212 of the top guard frame wall 21 outside the second end 222 of the bottom guard frame wall 22. As shown in FIG. 4, the tangent line A between the second end 212 of the top guard frame wall 21 and the bottom of the second end 222 of the bottom guard frame wall 22 defines with the vertical line B a contained angle θ of 20° through 30°, so that the optimal accommodation space 26 can be defined. Further, the top guard frame wall 21 comprises two downward guard flanges 213 respectively downwardly extending from two opposing lateral sides thereof toward the bottom guard frame wall 22. Each downward guard flange 213 has a chamfered edge 214 terminating in the second end 212 of the top guard frame wall 21. Further, the bottom guard frame wall 22 comprises two upward guard flanges 223 respectively upwardly extending from two opposing lateral sides thereof toward the top guard frame wall 21. Each upward guard flange 223 has a chamfered edge 224 terminating in the second end 222 of the bottom guard frame wall 22.

The two zipper tapes 1 and the zipper slider 2 are assembled, forming a double-layer nylon zipper, as shown in FIG. 1. This design of double-layer nylon zipper can be used in a travel bag 10, backpack, or the like, to protect stored items against loss of theft. According to the arrangement of the interlocking series of teeth 12 at each of opposing top and bottom sides of the narrow elongated fabric strip 11 of each of the two zipper tapes 1, the double-layer nylon zipper provides an excellent anti-piercing function.

Referring to FIGS. 2-5, the zipper slider 2 further comprises one or multiple eye lugs 27 located on the top side of the top guard frame wall 21 for the fastening of a padlock (not shown) to lock the zipper slider 2 to a predetermined part of the travel bag or backpack in which the double-layer nylon zipper is used, prohibiting any unauthorized person to open the double-layer nylon zipper.

Referring to FIGS. 6 and 7 and FIG. 1 again, to avoid friction between the stitching lines 13, which secure the respective interlocking series of teeth 12,12' to the narrow elongated fabric strips 11 of the respective zipper tapes 1, and the zipper slider 2, each coil element 121 of the interlocking series of teeth 12 at the top side of each zipper tape 1 defines a wire groove 124 on the coil body 123 thereof for receiving the respective stitching line 13. By means of respectively extending the stitching lines 13 over the wire grooves 124 the coil bodies 123 of the coil elements 121 of the respective series of teeth 12 at the top side of the respective zipper tapes 1 to secure the respective series of teeth 12,12' to the respective narrow elongated fabric strips 11, the zipper slider 2 will not touch the stitching lines 13 during its movement to close/open the double-layer nylon zipper, avoiding stitching line damage. Further, as shown in FIG. 8 and FIG. 9, the cloth strip 125 is covered over the coil body 123' of each coil element 121' of the interlocking series of teeth 12' at the bottom side of the narrow elongated fabric strip 11 of each zipper tape 1. When stitching the stitching line 13 to secure the cloth strip 125 to the narrow elongated fabric strip 11 of the respective zipper tape 1, the stitching line 13 can sink in the cloth strip 125, avoiding direct contact between the stitching line 13 and the zipper slider 2. Further, the position of the cloth strip 125 helps quick recognition of the front and back sides of the double-layer nylon zipper.

Figure 10:
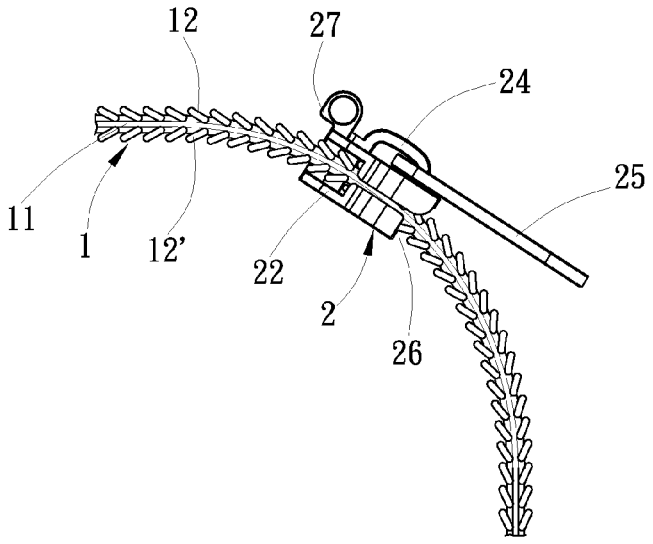
FIG. 10 is a schematic drawing of the present invention, illustrating the zipper slider moved relative to the zipper tapes.
Figure 11:
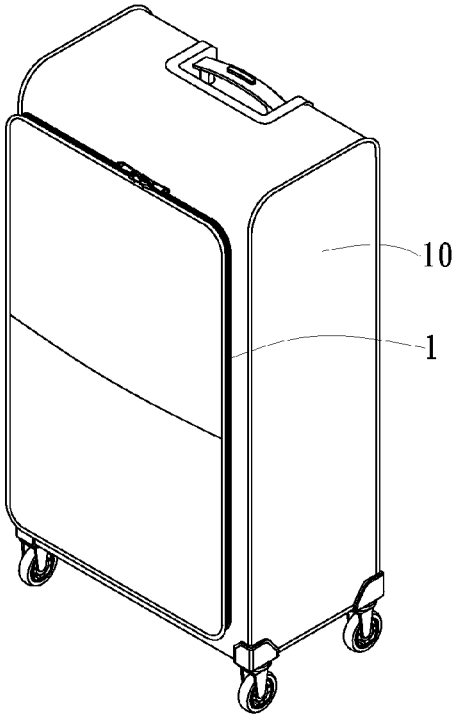
FIG. 11 is a schematic applied view of the present invention, illustrating the double-layer nylon zipper used in a travel bag.

Referring to FIGS. 10 and 11, the double-layer nylon zipper can be installed in a travel bag 10 or backpack. When pulling the zipper slider 2 over a corner of the travel bag 10 or backpack, the design of the accommodation space 26 and the chamfered edge 224 of each upward guard flange 223 of the bottom guard frame wall 22 effectively prevent interference between the zipper slider 2 and the interlocking series of teeth 12, thus facilitating smooth interlocking of the interlocking series of teeth 12 and preventing the zipper teeth from getting stuck or damaged.

Figure 12:
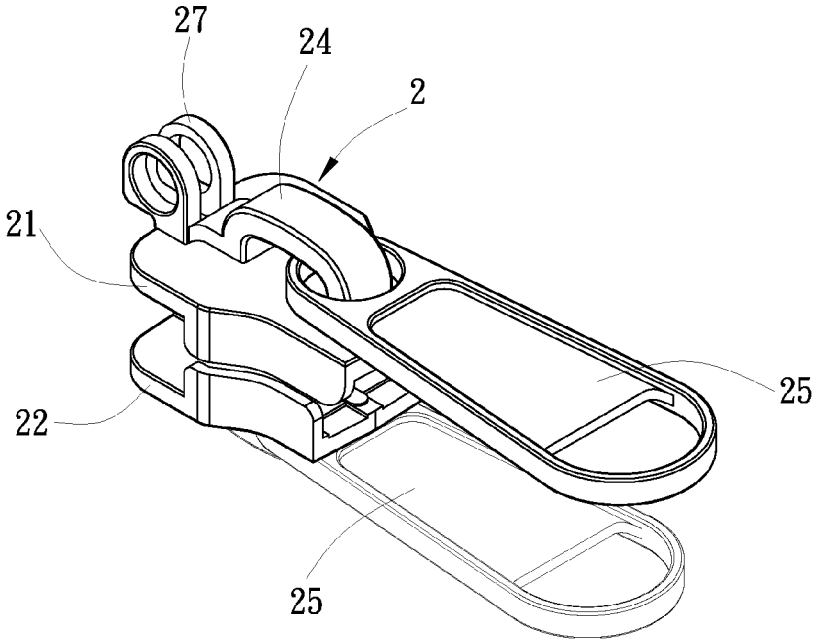
FIG. 12 is an oblique elevational view of an alternate form of the zipper slider in accordance with the present invention.
Figure 13:
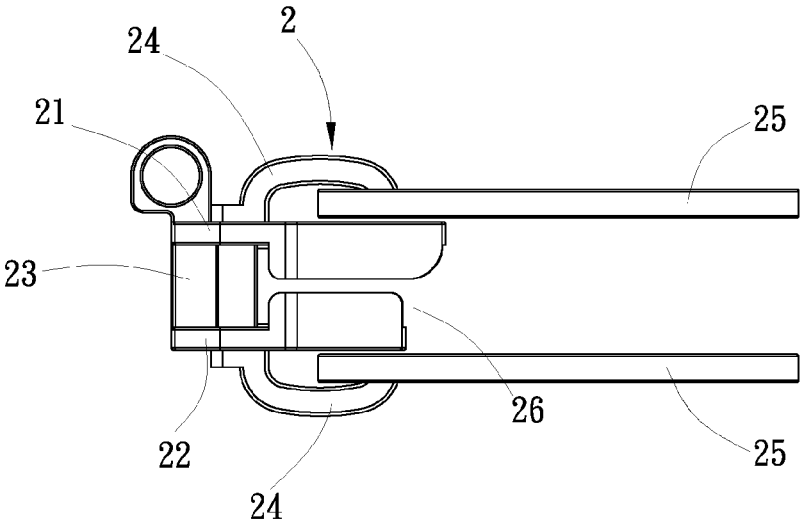
FIG. 13 is a side view of the zipper slider shown in FIG. 12.

FIGS. 12 and 13 illustrate an alternate form of the zipper slider 2. According to this alternate form, the zipper slider 2 comprises opposing top guard frame wall 21 and bottom guard frame wall 22, a division wall 23 vertically connected between the top guard frame wall 21 and the bottom guard frame wall 22, two noses 24 respectively protrude from the top guard frame wall 21 and the bottom guard frame wall 22, and two pull taps 25 respectively coupled to the noses 24. A double-layer nylon zipper using this alternate form of zipper slider 2 in accordance with the present invention is practical for use in a tent. Thus, a user can pull the zipper slider of the double-layer nylon zipper from the inside of the tent as well as from the outside of the tent.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A double-layer nylon zipper, comprising:

two zipper tapes, each said zipper tape comprising a narrow elongated fabric strip, two series of teeth respectively located on opposing top and bottom sides of said narrow elongated fabric strip each said series of teeth being formed of a series of coil elements made of a plastic wire material, each said coil element comprising a coil head, said coil head having a width greater than the diameter of said coil elements, a coil body connected to said coil head and a wire groove located on said coil body, a cloth strip covered over the coil body of each coil element of the series of teeth at the bottom side of said narrow elongated fabric strip, and a stitching line stitched to said narrow elongated fabric strip and said cloth strip and extended over a part of said cloth strip corresponding to the wire groove on the coil body of each coil element of the series of teeth at the bottom side of said narrow elongated fabric strip to secure said two series of teeth and said cloth strip to said narrow elongated fabric strip; and a zipper slider coupled between the interlocking series of teeth of said two zipper tapes, said zipper slider comprising top guard frame wall and an opposing bottom guard frame wall, a division wall vertically connected between said top guard frame wall and said bottom guard frame wall, a nose located on a top side of said top guard frame wall, and a pull tap coupled to said nose, said top guard frame wall and said bottom guard frame wall each comprising a first end and an opposing second end, the first end of said top guard frame wall and the first end of said bottom guard frame wall being disposed in a flush manner, said top guard frame wall being relatively longer than said bottom guard frame wall so that the second end of said top guard frame wall protrudes over the second end of said bottom guard frame wall, defining an accommodation space right below the second end of said top guard frame wall outside the second end of said bottom guard frame wall to prevent interference between the zipper slider and the two series of teeth and facilitate smooth interlocking of the two series of teeth while preventing the teeth from getting stuck or damaged when pulling the zipper slider over a curved corner area of the zipper tapes.

2. The double-layer nylon zipper as claimed in claim 1, wherein a line tangent to the second end of said top guard frame wall and to the second end of said bottom guard frame wall defines with a vertical line between the top and bottom guard frame walls a contained angle $\theta$ of 20° through 30°.

3. The double-layer nylon zipper as claimed in claim 1, wherein said top guard frame wall comprises two downward guard flanges respectively downwardly extending from two opposing lateral sides thereof toward said bottom guard frame wall.

4. The double-layer nylon zipper as claimed in claim 3, wherein each said downward guard flange comprises a chamfered edge terminating in the second end of said top guard frame wall.

5. The double-layer nylon zipper as claimed in claim 1, wherein said bottom guard frame wall comprises two upward guard flanges respectively upwardly extending from two opposing lateral sides thereof toward said top guard frame wall.

6. The double-layer nylon zipper as claimed in claim 5, wherein each said upward guard flange comprises a chamfered edge terminating in the second end of said bottom guard frame wall.

7. The double-layer nylon zipper as claimed in claim 1, wherein said zipper slider further comprises at least one eye lugs located on said top guard frame wall for fastening to a padlock.

8. The double-layer nylon zipper as claimed in claim 1, wherein the stitching line at each said zipper tape sinks in the respective cloth strip corresponding to the wire groove on the coil body of each coil element of the series of teeth at the bottom side of the associating narrow elongated fabric strip.

* * * * *